US005941440A

United States Patent [19]

Ohmae et al.

[11] Patent Number: 5,941,440

[45] Date of Patent: Aug. 24, 1999

[54] DRIVER OF STAPLE HAMMER

[75] Inventors: Hiroaki Ohmae; Nobuo Kishi; Katsuhisa Yata; Makoto Abe; Hirokazu Arai, all of Tokyo, Japan

[73] Assignee: Max Co., Ltd., Tokyo, Japan

[21] Appl. No.: 08/771,161

[22] Filed: Dec. 20, 1996

[30] Foreign Application Priority Data

Dec. 21, 1995 [JP] Japan ..... 7-333754

[51] Int. Cl.[6] ..... B25C 5/02

[52] U.S. Cl. ..... 227/119; 227/88

[58] Field of Search ..... 227/119, 87, 88, 227/86, 156, 129, 91, 93

[56] References Cited

U.S. PATENT DOCUMENTS

| | | | |
|---|---|---|---|
| 2,066,157 | 12/1936 | Pankonin | 1/3 |
| 2,431,812 | 12/1947 | Lang | 227/86 |
| 2,701,360 | 2/1955 | Lang | 227/86 |
| 2,923,938 | 2/1960 | Rinehardt | 1/49 |
| 3,905,535 | 9/1975 | Novak et al. | 227/120 |
| 4,485,955 | 12/1984 | Hagemann | 227/89 |
| 4,762,260 | 8/1988 | Richards et al. | 227/19 |
| 5,022,579 | 6/1991 | Matsutani et al. | 227/129 |

FOREIGN PATENT DOCUMENTS

| | | |
|---|---|---|
| 0 284 345 | 9/1988 | European Pat. Off. . |
| 36 41 477 | 6/1988 | Germany . |

*Primary Examiner*—Jessica J. Harrison
*Assistant Examiner*—John Paradiso
*Attorney, Agent, or Firm*—Morgan, Lewis & Bockius LLP

[57] ABSTRACT

Projected portions 17, 18, 19 are formed at three positions in the middle and on left and right ends of the front surface of a driver 13 of a staple hammer. The width of the projected portion 18 in the middle is smaller than the distance between both leg portions $S_3$, $S_4$ of a staple S, and the projected portion 18 is not in contact with the upper surfaces of bends $S_1$, $S_2$ of the staple S. Further, the distance between the projected portions 17, 19 on both left and right ends is slightly smaller than the total width of the staple S. The projected portions 17, 19 are located above the bends with radii, and are not in contact with the bends. At the time of hammering, the projected portion 18 in the middle impinges the middle portion of the top surface of the staple S, allowing both leg portions $S_3$, $S_4$ of the staple S to ground upon the object to be hammered so as to be expanded. At the time of penetration of the leg portions, the leg portions completely penetrate into the object to be hammered with the projected portions 17, 19 on both left and right ends contacting the bends.

18 Claims, 5 Drawing Sheets

DRIVER OF STAPLE HAMMER

BACKGROUND OF THE INVENTION

The invention relates to a driver of a staple hammer, and more particularly to a driver of a staple hammer that is designed to prevent staples from collapsing.

Staples of various dimensions suitable for various applications are available since staple fastening technique have been extensively used in building houses, doing interior finish work, and the like. The incidence of defective hammering due to collapsing staples increases with an increase in dimensions of staples.

Defective hammering is also related to the fact that hammering resistance increases with an increase in staple length. An example of defective hammering is the following situation. If the top surface of a staple is inclined to the left or to the right due to a staple forming inaccuracy or staple loading defect or if the adhesion strength of a staple is not balanced between the left and right sides, a stress applied to bends $S_1$, $S_2$ on both sides of a staple S that is hammered by a conventional driver D whose front end surface is flat is distributed unevenly on both of the left and right sides. As a result, a large stress is applied only to one of the bends, causing the distance between both leg portions $S_3$, $S_4$ on the left and right sides of the staple S to be narrowed. The leg portions $S_3$, $S_4$ of the staple S with the distance therebetween narrowed are hammered to penetrate into an object so as to come closer to each other in a crossing direction. Since the distance between the leg portions $S_3$, $S_4$ at the penetrating positions is smaller than the total width of the top surface of the staple S, the upper portion supported by both leg portions $S_3$, $S_4$ collapses before the completion of the staple penetration. This collapse causes a hammering defect such as an incomplete penetration of the leg portions into the object to be hammered B as shown in FIG. 5(*b*). In the case of a large collapse, the leg portions are jammed in the driver passage of the staple hammer, and as a result the operation may, in some cases, be hampered.

SUMMARY OF THE INVENTION

The invention has been made in view of the aforementioned circumstances. An object of the invention is to provide a driver of a staple hammer that can prevent a hammering defect due to a staple collapse by allowing both leg portions of a staple to be in parallel with each other and therefore prevent a reduction in operability.

To achieve the above object, the invention is applied to a driver of a staple hammer that is contained within the staple hammer, ascends and descends along a driver passage within a nose while driven by a prime mover such as compressed air or an electrically driven motor and a spring, and injects a staple by hammering a top surface of the staple supplied to the driver passage. In such a driver, three projected portions are formed on a front end surface of the driver so as to confront a middle portion and bends with radii on left and right ends of the top surface of the staple. The three projected portions have substantially the same height. The projected portion in the middle is designed so that only the projected portion in the middle comes in contact with the top surface of the staple at the time a staple hammering process starts.

DETAILED DESCRIPTION OF THE PREFERRED EMBODIMENTS

Figure 1:
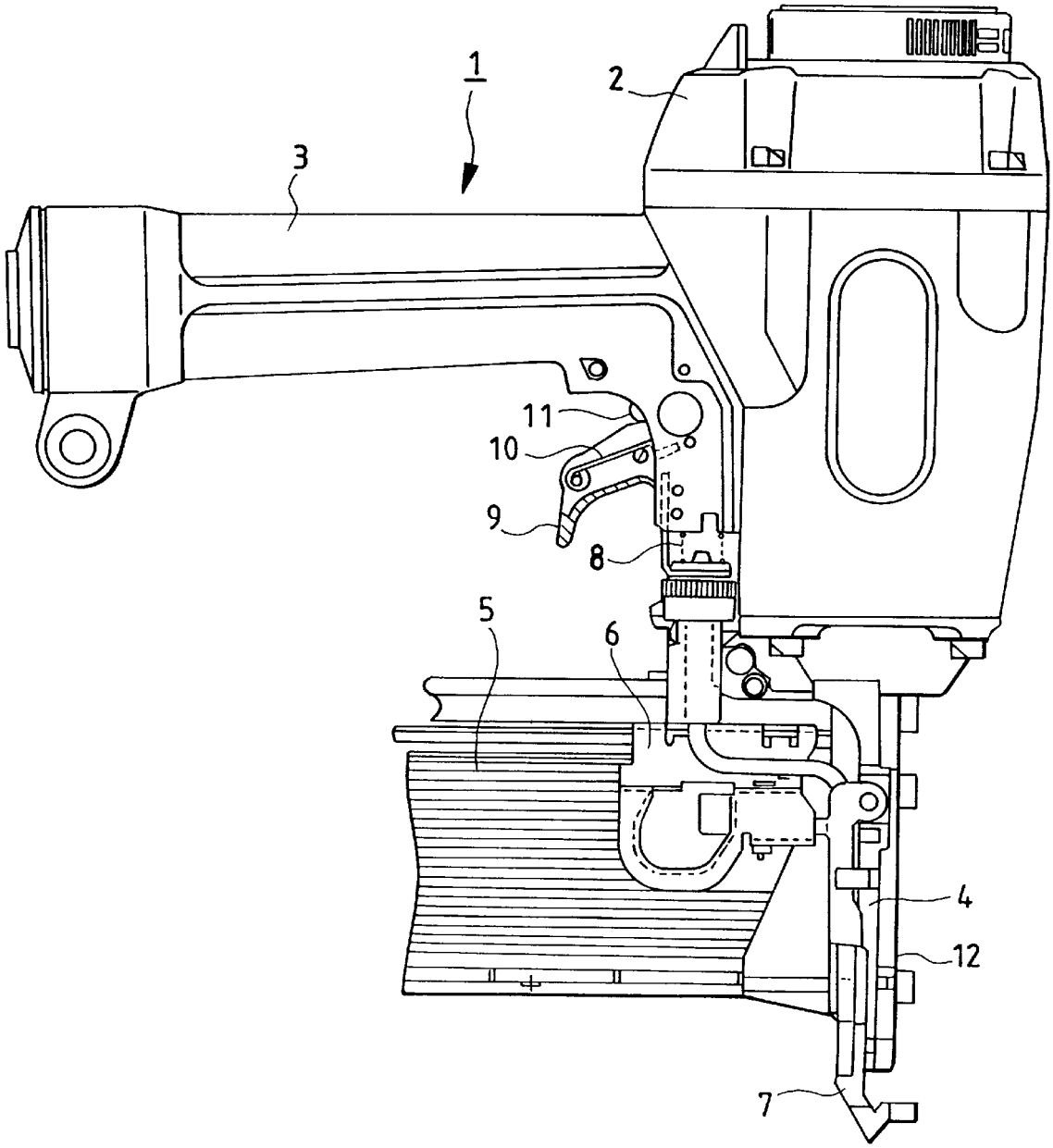
FIG. 1 is a side view of a pneumatic staple hammer.

One embodiment of the invention will now be described in detail in accordance with the drawings. FIG. 1 shows a staple hammer 1. The staple hammer 1 is designed so as to have high pressure air supplied thereto with a connector plug (not shown) of an air hose attached to the end of a grip 3 integrated with a housing 2 thereof and with the connector plug connected to an air compressor through the air hose. A nose block 4 is attached to the front end of the housing 2 that has an air cylinder formed therein. A staple guide 5 is coupled to the back surface of the nose block 4.

A staple pusher 6 is attached to the staple guide 5 and urged frontward so as to be slidable back and forth. The staple pusher 6 pushes a block of staples loaded to the staple guide 5 frontwardly to thereby bring the block of staples into pressure contact with the front end wall surface of a driver passage within the nose block 4.

A contact arm 7 attached to the nose block 4 so as to be vertically slidable is urged downward by a compression coil spring 8, so that the contact arm 7 projects downward from the front end of the nose block 4. The upper end of the contact arm 7 confronts a swing arm 10 that pivots about a trigger lever 9. When the contact arm 7 is brought into contact with and pushed against an object to be hammered and the trigger lever 9 is turned, the front end portion of the swing arm 10 pushes a stem 11 of a trigger valve (not shown) arranged at the base of the grip 3, so that the piston of the air cylinder is activated. The driver coupled to the piston descends along the driver passage within the nose block 4 and impinges upon the top surface of a staple, so that the staple is hammered into the object to be driven from the front end of the nose block 4.

Figure 2:
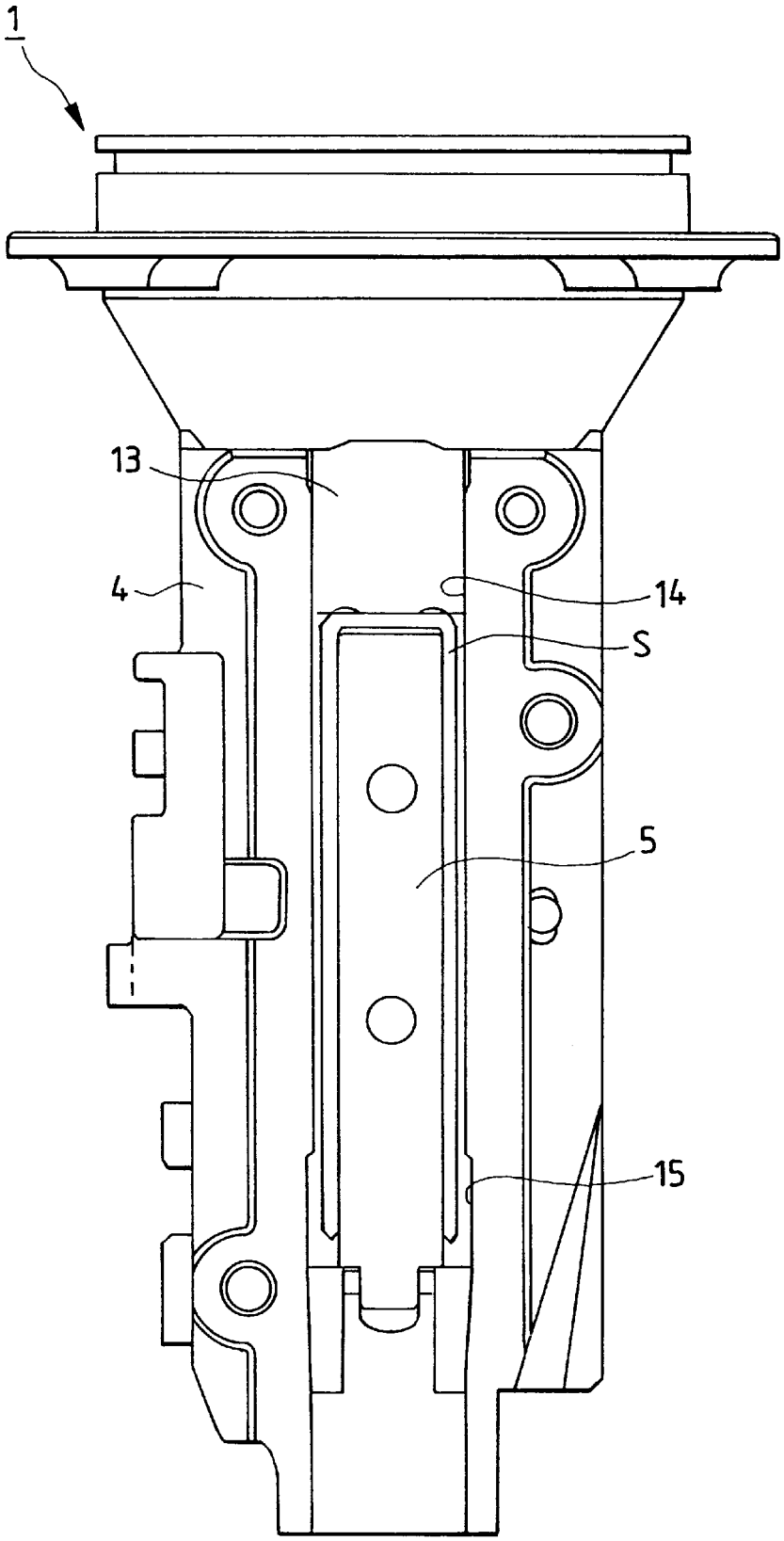
FIG. 2 is a front view of a nose block of the pneumatic staple hammer.

FIG. 2 is a front view of the staple hammer 1 with a front cover 12 of the nose block 4 of FIG. 1 removed. A sheetlike driver 13 and a driver passage 14 are formed in the middle of the front surface of the nose block 4 so as to extend vertically. The driver passage 14 is a recessed groove having the same width as that of a staple S. A staple introducing hole 15 passing through the rear surface is formed in the middle of the driver passage 14 as viewed in the vertical direction.

The lower portion of the nose block 4 projects rearward. The staple guide 5 is coupled to this projected portion. A staple S supported by the staple guide 5 is introduced into the driver passage 14 through the staple introducing hole 15, so that the staple S is ready to be hammered while having come in contact with the front cover 12 shown in FIG. 1.

Figure 3:
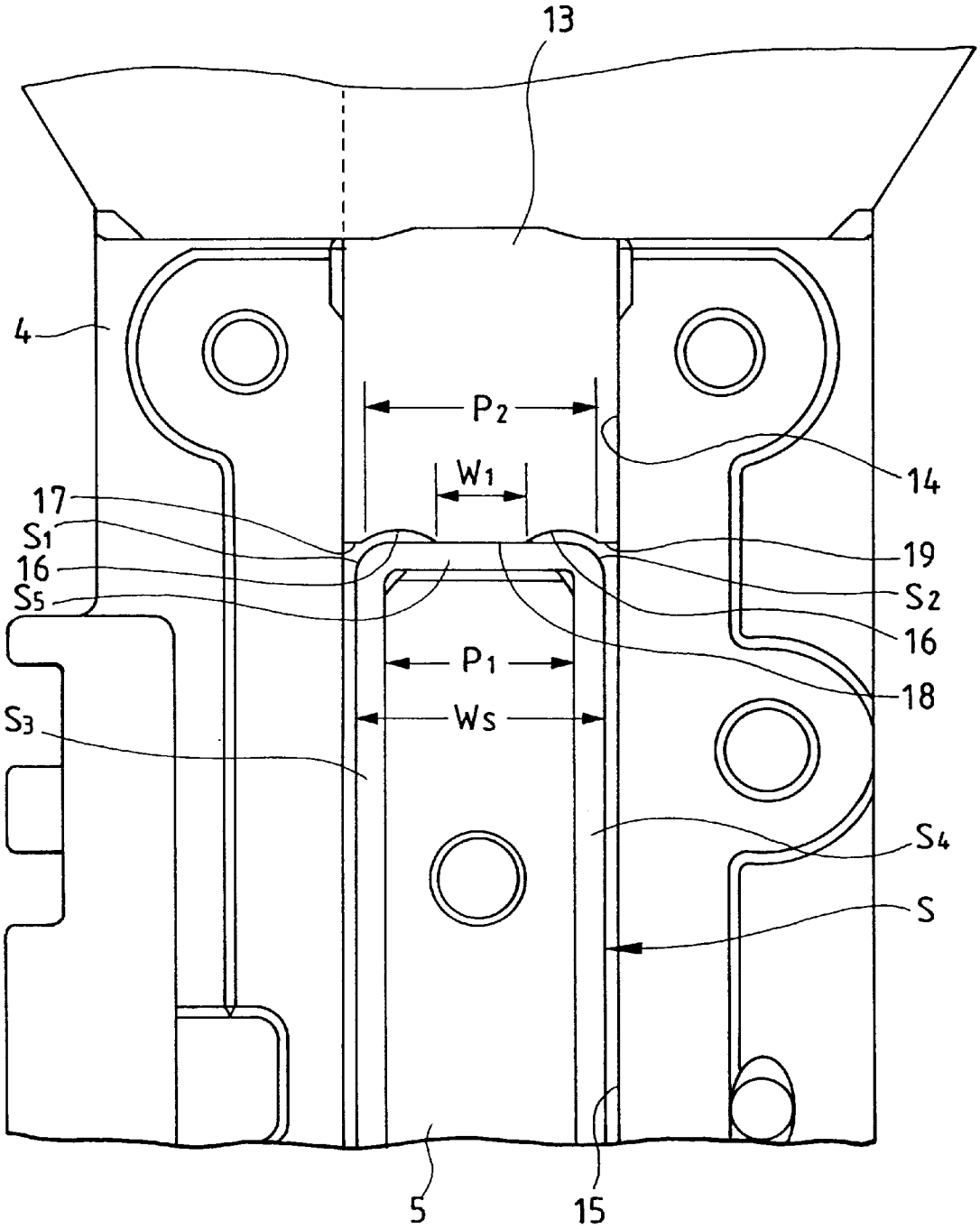
FIG. 3 is an enlarged view of a main portion of FIG. 2.
Figure 4:
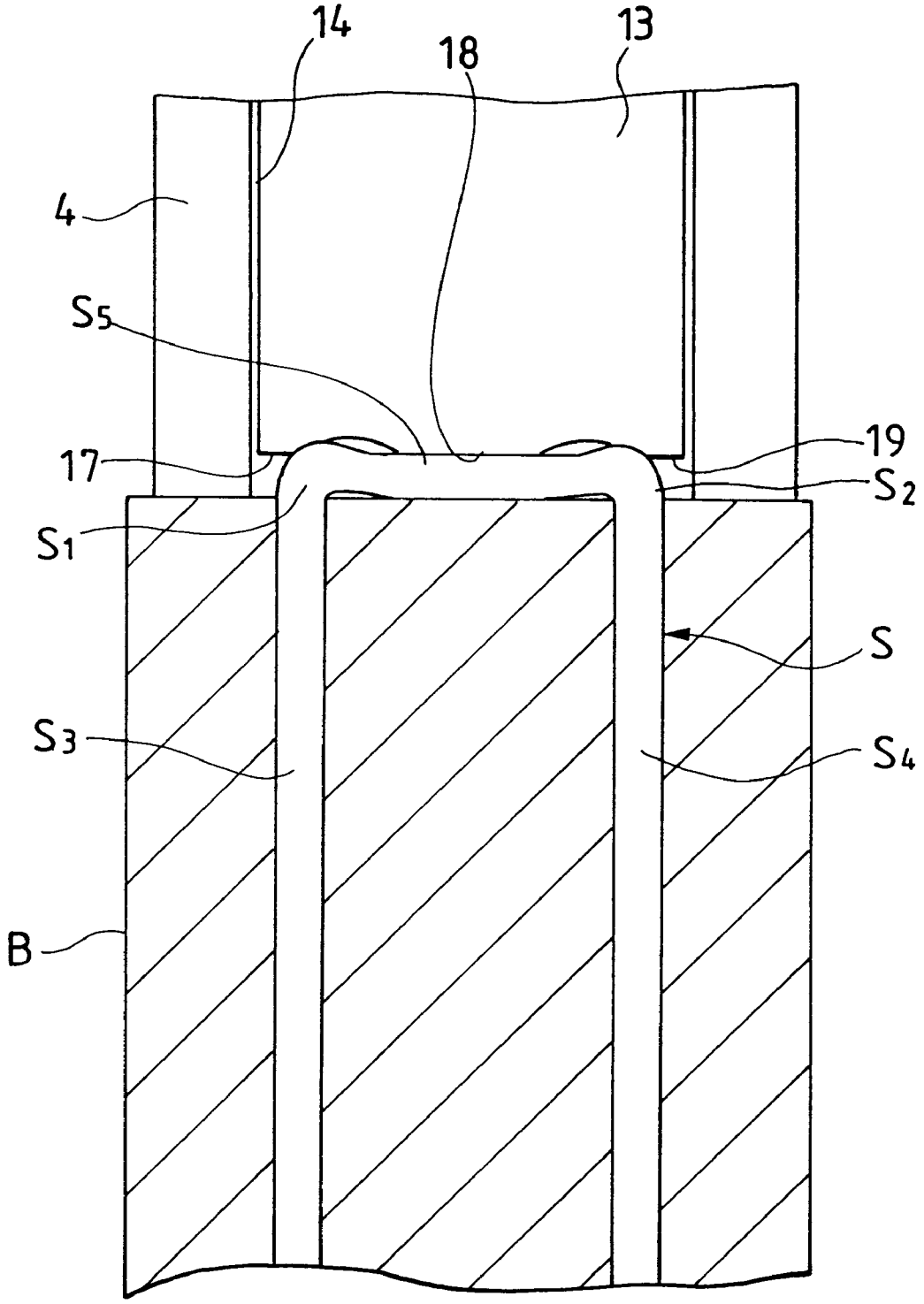
FIG. 4 is a diagram illustrative of how a staple is hammered by a driver of the invention.
Figure 5A:
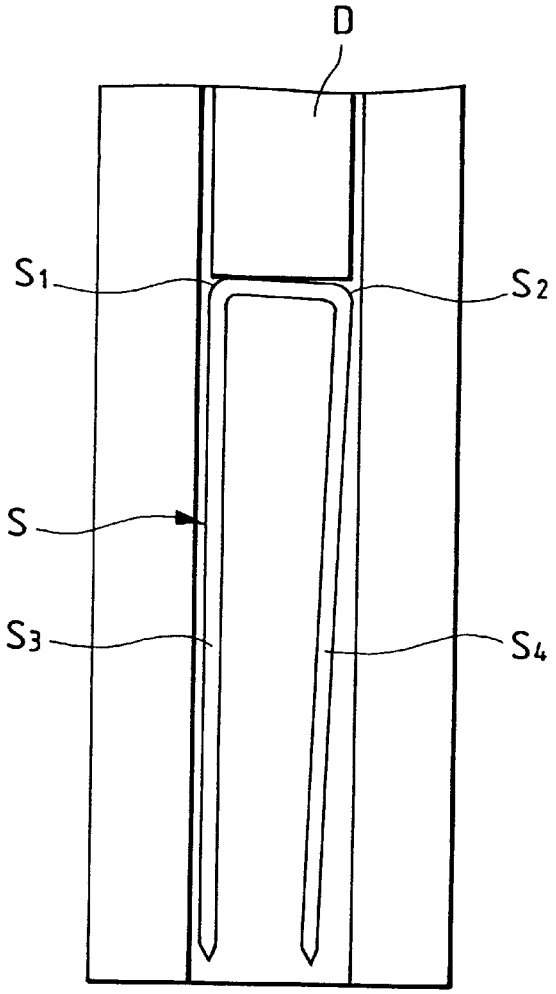
PRIOR ART FIG. 5(a)
FIG. 5(*a*) show a diagram illustrative of a deformed staple at the time of starting a conventional staple hammering process; and 5(*b*) a diagram illustrative of a collapsed staple.
Figure 5B:
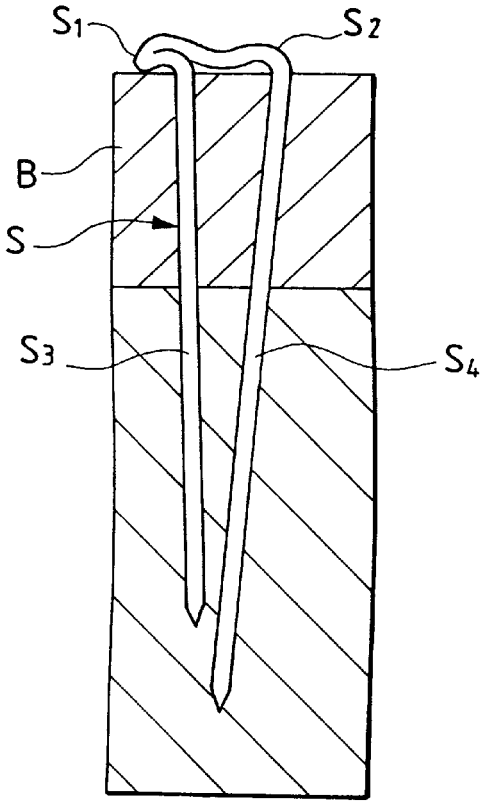
PRIOR ART FIG. 5(b)

As shown in FIG. 3, recessed portions 16 are formed so as to be horizontally symmetrical in the front end surface of the driver 13 (in a lower position as viewed in FIG. 3), so that projected portions 17, 18, 19 are formed in the middle and on both of the left and right ends. The three projected portions 17, 18, 19 have the same height and terminate in a common plane. The width $W_1$ of the projected portion 18 in the middle is smaller than the interval $P_1$ between inner sides of both leg portions $S_3$, $S_4$ of a staple S. projected portion 18 is not in contact with the upper surface of the bends $S_1$, $S_2$ that are the upper ends of both leg portions $S_3$, $S_4$ of the staple. Further, the distance $P_2$ between the projected portions 17, 19 on the left and right ends is slightly smaller than the total width $W_S$ of the staple S. The projected portions 17, 19 are located above the rounded corners of the bends $S_1$, $S_2$, and as shown in FIG. 3, the projected portions 17, 19 are not in contact with the bends $S_1$, $S_2$ when the projected portion 18 in the middle is in contact with the top surface of the intermediate or body portion $S_5$ that bridges both leg portions $S_3$, $S_4$ of the staple S.

When the driver 13 descends from an upper standby position with the piston within the air cylinder activated by the operation of the trigger lever 9, the projected portion 18 in the middle collides with the top surface of the staple S as shown in FIG. 3. The stress applied to the middle portion of the top surface upon impingement expands the leg portions $S_3$, $S_4$ of the staple S, causing the leg portions $S_3$, $S_4$ to ground upon the object to be hammered so they are parallel with each other or slightly expanded.

When the intermediate portion $S_5$ of the staple S pressed by the driver 13 starts deforming so as to collapse due to a hammering resistance of the leg portions while the leg portions $S_3$, $S_4$ are penetrating into an object, the bends $S_1$, $S_2$ regulate the deformation of the intermediate portion $S_5$ by coming in contact with the projected portions 17, 19 on both of the left and right ends, so that both leg portions $S_3$, $S_4$ are completely hammered into the object B. Therefore, a long and large staple can be hammered satisfactorily with the bends $S_1$, $S_2$ not floating from the surface of the object to be hammered.

It may be noted that the invention is not limited to the aforementioned embodiment. The invention may be modified in various modes within the technical scope thereof, and the effects of the invention extend to such modifications.

As described in the foregoing in detail, the driver of the staple hammer of the invention is characterized as allowing a staple to ground by hammering the middle portion of the top surface of the staple and urging both leg portions of the staple to expand. Therefore, the leg portions of the staple are no longer hammered which causes them to come closer to each other as in a conventional driver. Hence, defective hammering due to collapses of staples can be prevented. The invention is also characterized as allowing both leg portions to penetrate into the object to be hammered completely with the projected portions of the driver on both left and right ends pressing both leg portions of a staple. As a result, satisfactory hammering can be implemented without allowing the staple to float.

What is claimed is:

1. An improved driver of a staple hammer, the driver being contained within the staple hammer, ascending and descending along a driver passage within a nose of the staple hammer while driven by either compressed air or an electrically driven motor and a spring, and injecting a staple by hammering a top surface of the staple supplied to the driver passage, the improvement comprising:

three projected portions formed on a front end surface of the driver, the projected portions located so as to be aligned with the middle portion and bends on left and right ends of a top surface of the staple, the three projected portions having substantially the same height, the projected portion in the middle being designed so that only the projected portion in the middle comes in contact with the top surface of the staple at the start of a staple hammering process.

2. A driver for a staple hammer, the driver being contained within the staple hammer, the driver comprising:

a driver body having a front end surface; and three projected portions formed on said front end surface, the projected portions located so as to be aligned with a middle portion and bends on left and right ends of a top surface of a staple, the three projected portions having substantially the same height, the projected portion in the middle being designed so that only the projected portion in the middle comes in contact with the top surface of the staple at the start of a staple hammering process.

3. The driver according to claim 2, wherein recessed portions are formed between the three projected portions and are horizontally symmetrical in the front end surface of the driver body, the width of the middle projected portion is smaller than a distance between leg portions of a staple, and a distance between the projected portions on the left and right ends is slightly smaller than the total width of the staple.

4. The improved driver according to claim 1, wherein recessed portions are formed between said projected portions and are horizontally symmetrical in said front end.

5. The improved driver according to claim 1, wherein said middle projected portion has a width that is smaller than a distance between leg portions of said staple.

6. The improved driver according to claim 1, wherein the distance between said projected portions on the left and right ends is slightly smaller than the total width of said staple.

7. The improved driver according to claim 1, wherein said projected portions are coplanar.

8. The driver according to claim 2, wherein said projected portions are coplanar.

9. The driver according to claim 1, wherein said driver has a substantially planar driver side surface extending onto said middle projected portion.

10. The driver according to claim 2, wherein said driver body has a substantially planar driver side surface extending onto said middle projected portion.

11. A driver for a staple hammer adapted to drive a U-shaped staple having a body portion with a top surface, two leg portions depending from respective ends of the body portion and having a predetermined distance between opposing inner sides of the leg portions, and having bends at the junction between the top surface and the outer sides of the leg portions, comprising:

a driver body having an end surface;

a first projected portion formed on said end surface and disposed to contact the top surface of the staple; and second and third projected portions formed on said end surface, laterally spaced from said first projected portion and disposed to be spaced from the bends of the staple when said first projected portion is in contact with the top surface.

12. The driver according to claim 11, wherein said projected portions are disposed so as to be aligned with the upper surface and the bends of the staple.

13. The driver according to claim 11, wherein recessed portions are formed between said projected portions in the end surface of the driver body.

14. The driver according to claim 13, wherein said recessed portions are symmetrically formed about said first projected portion.

15. The driver according to claim 11, wherein said first projected portion has a width that is smaller than said predetermined distance between the inner sides of the legs of the staple.

16. The driver according to claim 11, wherein the distance between said second and third projected portions is slightly smaller than the total width of the staple.

17. The driver according to claim 11, wherein said projected portions are coplanar.

18. The driver according to claim 11, wherein said driver body has a substantially planar driver side surface extending onto said first projected portion.

* * * * *